US005816222A

United States Patent [19]

Kidokoro

[11] Patent Number: 5,816,222

[45] Date of Patent: Oct. 6, 1998

[54] DEFECT DIAGNOSING APPARATUS FOR EVAPORATIVE PURGE SYSTEM

[75] Inventor: Toru Kidokoro, Hadano, Japan

[73] Assignee: Toyota Jidosha Kabushiki Kaisha, Toyota, Japan

[21] Appl. No.: 908,207

[22] Filed: Aug. 7, 1997

[30] Foreign Application Priority Data

Aug. 12, 1996 [JP] Japan ..... 8-212611

[51] Int. Cl.[6] ..... F02M 37/04

[52] U.S. Cl. ..... 123/520; 123/357

[58] Field of Search ..... 123/520, 519, 123/518, 516, 521, 357

[56] References Cited

U.S. PATENT DOCUMENTS

| | | | |
|---|---|---|---|
| 5,295,472 | 3/1994 | Otsuka | 123/520 |
| 5,398,661 | 3/1995 | Denz | 123/198 D |
| 5,425,344 | 6/1995 | Otsuka | 123/520 |
| 5,429,097 | 7/1995 | Wojts-Saary | 123/198 D |
| 5,479,905 | 1/1996 | Ito | 123/198 D |
| 5,483,942 | 1/1996 | Perry | 123/198 D |
| 5,617,832 | 4/1997 | Yamazaki | 123/198 D |
| 5,629,477 | 5/1997 | Ito | 123/520 |
| 5,635,630 | 6/1997 | Dawson | 123/520 |
| 5,653,217 | 8/1997 | Ishizawa | 123/198 D |
| 5,680,849 | 10/1997 | Morikawa et al. | 123/198 D |

*Primary Examiner*—Carl S. Miller
*Attorney, Agent, or Firm*—Kenyon & Kenyon

[57] ABSTRACT

From the relationship between the pressure change in the evaporative purge system during purge cutting and the valve opening pressure of an air intake valve, respective valve opening pressures of a tank internal pressure regulating valve and a back-purge valve, each opening and closing a vapor passage, are found. As an actual valve opening pressure is found, the diagnosis can be effected under the circumstances where the tank internal pressure regulating valve or the back-purge valve is securely closed, whereby defect diagnosis can be effected as frequently as possible without setting a diagnosable pressure range such as that required conventionally.

12 Claims, 9 Drawing Sheets

DEFECT DIAGNOSING APPARATUS FOR EVAPORATIVE PURGE SYSTEM

BACKGROUND OF THE INVENTION

1. Field of the Invention

The present invention relates to a defect diagnosing apparatus for evaporative purge system which diagnoses defects in an evaporative purge system extending from a fuel tank to a purge passage by way of a canister.

2. Related Background Art

A conventional defect diagnosing apparatus for evaporative purge system is disclosed in Japanese Patent Application Laid-Open No. 6-108930.

SUMMARY OF THE INVENTION

FIG. 8 shows a defect diagnosing apparatus for evaporative purge system. In this apparatus, a fuel tank 101 and a canister 102 are connected to each other by a vapor passage 103, which is opened and closed by a tank internal pressure regulating valve 104 and a back-purge valve 105. Also, a pressure sensor 107 is connected to a common port of a three-way VSV (Vacuum Switching Valve) 106. As the three-way VSV 106 is switched, an in-system pressure on the canister 102 side and an in-system pressure on the fuel tank 101 side, which are separated from each other by the tank internal pressure regulating valve 104 and the back-purge valve 105, can be measured by the pressure sensor 107 independently of each other.

When the in-system pressure on the fuel tank 101 side becomes at least as high as a predetermined pressure under the influence of a vapor (evaporated fuel) generated in the fuel tank 101, the tank internal pressure regulating valve 104 opens, thereby communicating the fuel tank 101 and the canister 102 to each other. On the other hand, in the case where the amount of vapor generated due to the fuel consumption is greater than the vapor generated in the fuel tank 101 or the case where the pressure on the fuel tank 101 side is lower than the pressure on the canister 102 side under the influence of a change in atmospheric pressure when descending a slope, the back-purge valve 105 opens, thereby communicating the fuel tank 101 and the canister 102 to each other. Thus, the tank internal pressure regulating valve 104 and the back-purge valve 105 function as pressure regulating valves for adjusting the in-system pressure on the fuel tank 101 side so as to place it within a predetermined range.

For defect diagnosis on the canister 102 side, the three-way VSV 106 is switched to the canister 102 side, so that the pressure sensor 107 is connected to a system path on the canister 102 side. A purge duty VSV (purge D-VSV) 108 for purge control is opened, so as to introduce a negative pressure generated in the intake passage during engine operation into the canister 102 by way of a purge passage 109. After the introduction of the negative pressure, the purge duty VSV 108 is closed, and a pressure behavior thereafter is detected by the pressure sensor 107.

After purge cutting, the pressure on the canister 102 side (canister internal pressure) gradually changes toward the atmospheric pressure. When leakage occurs in this system due to perforation or the like, as shown in FIG. 9, a pressure change $\Delta P_0'$ per a predetermined time t is greater than its corresponding pressure change $\Delta P_0$ in the case where no leakage occurs. When this phenomenon is utilized to measure the pressure behavior after the purge cutting, it is judged whether there is a defect in the subject system or not.

Nevertheless, there is a case where, during the defect diagnosis, the amount of vapor generated in the fuel tank 101 increases such that the tank internal pressure regulating valve 104 opens. In this case, the vapor within the fuel tank 101 flows into the canister 102 side, thereby increasing the in-system pressure on the canister 102 side during the defect diagnosis. As a result, though there is really no defect such as perforation within the system on the canister 102 side, the pressure may change as indicated by $\Delta P_0'$ (FIG. 9) as if a defect exists. Accordingly, there have been cases where it may erroneously be judged that the defect exists within this system.

Also, there is a case where, during the defect diagnosis, the pressure on the fuel tank 101 side is lower than the pressure on the canister 102 side such that the back-purge valve 105 opens. In this case, there occurs so-called back purge, i.e., air flowing backward from the canister 102 side to the fuel tank 101 side. Here, when there is perforation within the system on the canister 102 side, the air drawn in from a perforated portion is attracted to the fuel tank 101 side due to the back purge. As a result, though there is really a defect such as perforation within the system on the canister side, the pressure may behave as if there is no defect. Accordingly, there have been cases where it may erroneously be judged that no defect exists within the system.

Accordingly, the defect diagnosis within the system on the canister 102 side is preferably performed in the state where the passage of vapor between the fuel tank 101 and the canister 102 is blocked. For this purpose, the condition for detecting a defect within the system on the canister 102 side may be restricted to a case where the pressure on the fuel tank 101 side is lower than the valve opening pressure of the tank internal pressure regulating valve 104 while the pressure difference between the fuel tank 101 side and the canister 102 side is lower than the valve opening pressure of the back-purge valve 105. When a diagnosable pressure range is to be set beforehand in such a manner, however, the pressure range is inevitably set narrower in order to secure the reliability in diagnosis in view of the fluctuation in manufacture of the pressure sensor or its deterioration over time. As a result, the frequency of defect diagnosis may become lower.

In order to overcome such problems, it is an object of the present invention to provide a defect diagnosis apparatus for evaporative purge system, which can perform highly reliable defect diagnosis without lowering the frequency of diagnosis.

Hence, the defect diagnosis apparatus for evaporative purge system in accordance with the first manner is a defect diagnosis apparatus for evaporative purge system for diagnosing defect of an evaporative purge system, the evaporative purge system comprising a canister, connected to a fuel tank by way of a vapor passage, for absorbing a vapor generated in the fuel tank; a purge passage for introducing into an intake passage of an internal combustion engine the vapor desorbed from the canister; and an air intake valve adapted to open when the pressure in the canister is lower than a predetermined pressure, so as to feed an air into the canister; the defect diagnosis apparatus comprising a pressure regulating valve for opening and closing the vapor passage so as to adjust a pressure within the fuel tank; pressure detecting means, connected to the evaporative purge system extending from the fuel tank to the purge passage, for detecting, independently of each other, a pressure on the fuel tank side and a pressure on the canister side, separated from each other by the pressure regulating valve; evaluating means for evaluating, according to a pressure detected by the pressure detecting means, whether there is a defect in the evaporative purge system or not; and learning means for learning, based on a pressure in the evaporative purge system during purge cutting and a valve opening pressure of the air intake valve, a valve opening pressure of the pressure regulating valve.

As the learning means is provided, an actual valve opening pressure of the pressure regulating valve can be grasped, and this result of learning can be utilized to perform defect diagnosis of the evaporative purge system under the circumstances where the pressure regulating valve is securely closed.

In the defect diagnosis apparatus for evaporative purge system in accordance with the second manner, the pressure regulating valve in the first manner is a tank internal pressure regulating valve adapted to open when the pressure on the fuel tank side is higher than a predetermined pressure, so as to communicate the fuel tank and the canister to each other; whereas the learning means in the first manner comprises valve opening pressure storing means for storing a valve opening pressure of the tank internal pressure regulating valve, and valve opening pressure updating means for causing, at a time when the pressure on the canister side during purge cutting is at least as high as the valve opening pressure of the air intake valve, the valve opening pressure storing means to store, as a new valve opening pressure of the tank internal pressure regulating valve, the pressure on the fuel tank side at this time.

In the case where there is no vapor flowing from the fuel tank side, the pressure on the canister side after purge cutting is stabilized at the valve opening pressure of the air intake valve. Accordingly, when the pressure on the canister side during purge cutting becomes higher than the valve opening pressure of the air intake valve, it can be judged that the vapor generated in the fuel tank is flowing into the canister side. Hence, the valve opening pressure updating means causes the valve opening pressure storing means to store, as a new valve opening pressure of the tank internal pressure regulating valve, the pressure on the fuel tank side detected at this time.

The defect diagnosis apparatus for evaporative purge system in accordance with the third manner further comprises inhibiting means for inhibiting, when the pressure on the fuel tank side detected before the defect evaluation on the canister side is not lower than the valve opening pressure stored in the valve opening pressure storing means, the evaluating means from performing the defect evaluation on the canister side.

When the pressure on the fuel tank side is detected by the pressure detecting means prior to the defect diagnosis on the canister side, and thus detected pressure is not lower than the valve opening pressure stored in the valve opening pressure storing means, it can be judged that the tank internal pressure regulating valve is opened so as to allow the vapor to flow into the canister side. Since defect diagnosis cannot be performed correctly under such circumstances, the inhibiting means causes the evaluating means to stop performing the defect evaluation on the canister side.

In the defect diagnosis apparatus for evaporative purge system in accordance with the fourth manner, the pressure regulating valve in the first manner is a back-purge valve adapted to open when the pressure on the fuel tank side is lower than the pressure on the canister side by at least a predetermined pressure, so as to communicate the fuel tank and the canister to each other; whereas the learning means in the first manner comprises valve opening pressure storing means for storing a valve opening pressure of the back-purge valve, and valve opening pressure updating means for causing, at a time when the pressure on the canister side during purge cutting is substantially stabilized at a pressure lower than the valve opening pressure of the air intake valve, the valve opening pressure storing means to store, as a new valve opening pressure of the back-purge valve, a pressure difference between the pressures on the canister side and the fuel tank side at this time.

In the case where there is no back purge from the canister side, the pressure on the canister side after purge cutting is stabilized at the valve opening pressure of the air intake valve. Accordingly, when the pressure on the canister side during purge cutting is substantially stabilized at a pressure lower than the valve opening pressure of the air intake valve, it can be judged that back purging is effected from the canister side to the fuel tank side. Hence, the valve opening pressure updating means causes the valve opening pressure storing means to store, as a new valve opening pressure of the back-purge valve, the pressure difference between the pressures on the canister side and the fuel tank side detected at this time.

The defect diagnosis apparatus for evaporative purge system in accordance with the fifth manner further comprises inhibiting means for inhibiting, when the pressure difference between the pressures on the canister side and the fuel tank side detected before the defect evaluation on the canister side is not lower than the valve opening pressure stored in the valve opening pressure storing means, the evaluating means from performing the defect evaluation on the canister side.

When the pressure difference between the canister side and the fuel tank side is detected by the pressure detecting means prior to the defect diagnosis on the canister side, and thus detected pressure is not lower than the valve opening pressure stored in the valve opening pressure storing means, it can be judged that the back-purge valve is opened so as to allow back purging from the canister side to the fuel tank side. Since defect diagnosis cannot be performed correctly under such circumstances, the inhibiting means causes the evaluating means to stop performing the defect evaluation on the canister side.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, an embodiment of the present invention will be explained with reference to the accompanying drawings.

Figure 1:
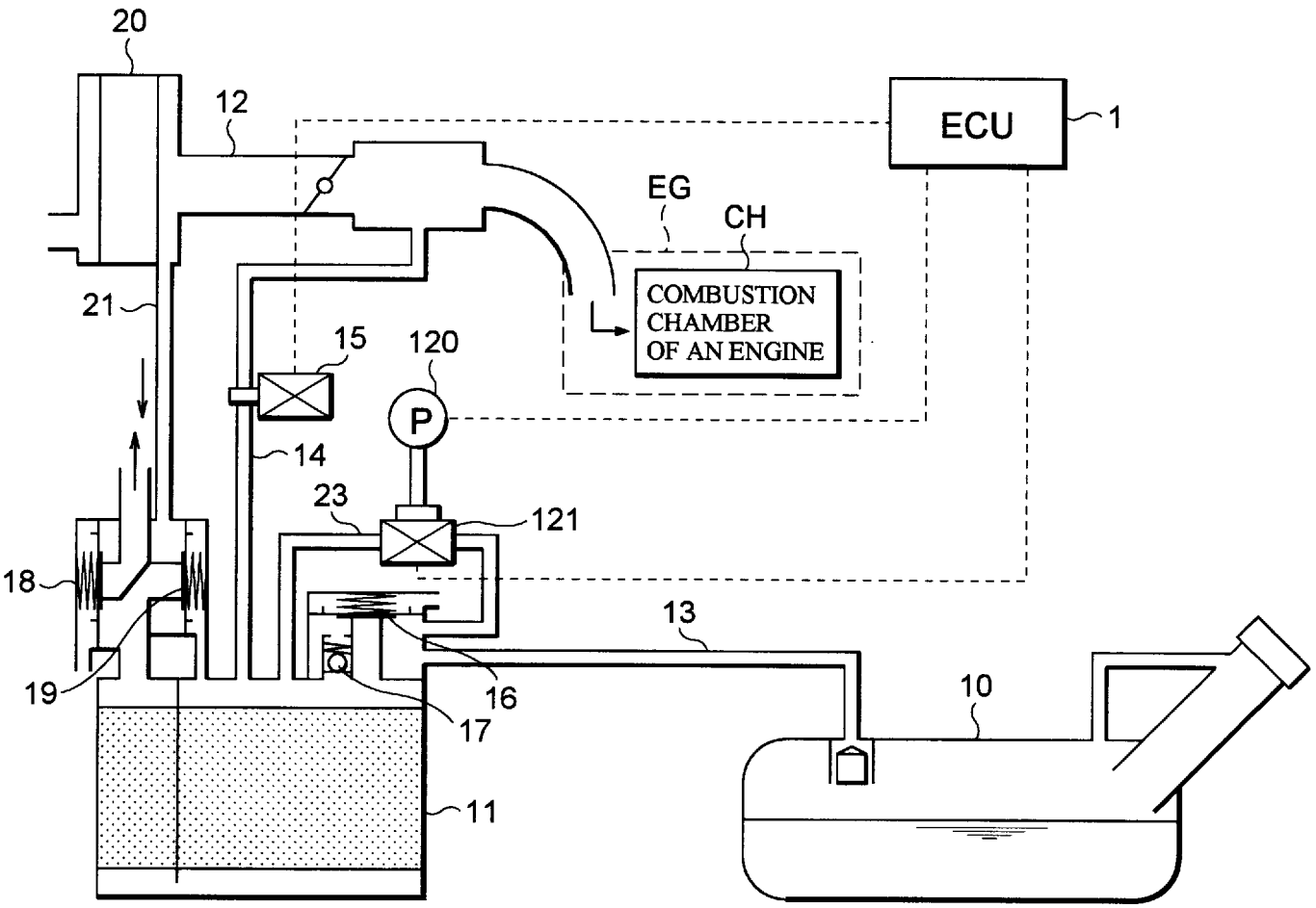
FIG. 1 is a configurational view showing the defect diagnosis apparatus for evaporative purge system in accordance with this embodiment.

FIG. 1 shows an evaporative purge system equipped with the defect diagnosis apparatus in accordance with this embodiment. This evaporative purge system is a system in which vapor (evaporated fuel) generated in a fuel tank 10 is temporarily absorbed by a charcoal canister 11 (hereinafter referred to as canister), and a negative pressure generated in an intake passage (suction passage) 12 during engine operation is utilized to desorb the absorbed vapor from the canister 11 and introduce thus desorbed vapor into the intake passage 12. Thus introduced vapor is subjected to a burning process in a combustion chamber of an internal combustion engine. The fuel tank 10 and the canister 11 are connected to each other by a vapor passage 13, while the canister 11 and the intake passage 12 are connected to each other by a purge passage 14, thereby constituting the evaporative purge system.

The purge passage 14 is provided with an electromagnetic purge duty VSV (Purge Duty Vacuum Switching Valve) 15, which opens and closes in response to an electric signal received from an electronic control unit 1 (referred to as "ECU" hereinafter), thereby duty-controlling the amount of vapor caused to flow into the intake passage 12. Here, the ECU 1 is constituted by CPU, ROM, RAM, backup RAM, and the like.

Disposed at a junction part between the vapor passage 13 and the canister 11 are a tank internal pressure regulating valve 16 and a back-purge valve 17. When vapor is generated in the fuel tank 10 such that the pressure therein becomes higher than a predetermined pressure, the tank internal pressure regulating valve 16 opens so as to communicate the fuel tank 10 to the canister 11. When the pressure on the fuel tank 10 side is lower than the pressure on the canister 11 side by at least a predetermined pressure, the back-purge valve 17 opens so as to communicate the fuel tank 10 to the canister 11, thereby preventing the fuel tank 10 from breaking. Thus, the tank internal pressure regulating valve 16 and the back-purge valve 17 function as pressure regulating valves for adjusting the in-system pressure on the fuel tank 10 side so as to place it within a predetermined range.

The canister 11 comprises an air release valve 18 which opens when a predetermined positive pressure is attained in the canister 11, thereby opening the canister 11 to the atmosphere, and an air intake valve 19 which opens when a predetermined negative pressure is attained in the canister 11 due to purging, thereby causing the air to flow into the canister 11. The air intake valve 19 is connected, by way of a suction passage 21, to the downstream side of a filter 20 which is attached to the intake passage 12, whereby the air, from which dust has been eliminated by the filter 20, is introduced into the canister 11 by way of the air intake valve 19.

In order to diagnose defects of thus configured evaporative purge system, provided is a pressure sensor 120 for detecting the pressure in the system. This pressure sensor 120 is connected to a fixed port of a three-way VSV 121. Of the remaining two ports, one is connected to the vapor passage 13 by way of a passage 22, whereas the other is connected to the canister 11 by way of a passage 23. Consequently, upon switching operations of the three-way VSV 121, the pressure sensor 120 can detect either the in-system pressure on the fuel tank 10 side or that on the canister 11 side, which are separated from each other by the tank internal pressure regulating valve 16 and the back-purge valve 17.

The pressure sensor 120, three-way VSV 121, and purge duty VSV 15 are individually connected to the ECU 1. The pressure signal from the pressure sensor 120 is supplied to the ECU 1, whereas the switching operations of the three-way VSV 121 and the valve opening and closing operations of the purge duty VSV 15 are performed under the control of the ECU 1.

The operations of thus configured evaporative purge system will schematically be explained. When the internal combustion engine is started, and then a predetermined purge condition (e.g., detection of completion of the engine warmup or detection of a predetermined amount of engine load or higher) is established, the purge duty VSV 15 is actuated under the control of the ECU 1, thereby purging the vapor absorbed by the canister 11. When the purge duty VSV 15 opens, the negative pressure in the intake passage 12 is introduced into the canister 11 by way of the purge passage 14. Consequently, the air intake valve 19 opens, whereby the air transmitted through the air filter 20 is introduced into the canister 11. The air transmitted through the canister 11 purges the vapor absorbed in the canister 11 and then is introduced into the intake passage 12. The canister internal pressure during purging becomes negative since the air release valve 18 is in a closed state, thereby being controlled by the air intake valve 19 so as to attain a constant negative level. Also, the ECU 1 controls the opening and closing operations of the purge duty VSV 15 such that the influence of purge gas upon the exhaust emission is minimized. As such a series of operations are repeatedly performed, the vapor is prevented from being released into the atmosphere, and the canister 11 is kept from overflowing.

Here, the processing operation of such a defect diagnosis apparatus for evaporative purge system will be explained. While the diagnosis processing in this defect diagnosis operation is performed in view of both the valve opening pressure of the tank internal pressure regulating valve 16 and the valve opening pressure of the back-purge valve 17, for the sake of explanation, the case where the valve opening pressure of the tank internal pressure regulating valve 16 is taken into consideration and the case where the valve opening pressure of the back-purge valve 17 is taken into consideration will be explained separately from each other.

First, the defect diagnosis processing in the case where the valve opening pressure of the tank internal pressure regulating valve 16 is taken into consideration will be explained with reference to the flow chart of FIG. 2. This processing operation is a routine processing which is performed, for example, at every predetermined time in the ECU 1 in the state where purging is effected.

When this processing, which is started at step 100 (hereinafter step being referred to as S), is actuated, the three-way VSV 121 is switched to the fuel tank 10 side so as to connect the pressure sensor 120 to a system path on the fuel tank 10 side, thereby detecting the pressure in this system (S101).

Then, it is judged whether a condition for updating a learned value of the valve opening pressure of the tank internal pressure regulating valve 16 is established or not (S102). Examples of this condition include the distance traveled and number of travels from the point of time where the last learning is effected. The learning of the valve opening pressure is effected for every predetermined travel distance or number of travels. In the case where it is judged that the condition for updating the learned value is established ("Yes" at S102), the valve opening pressure learning end flag for the tank internal pressure regulating valve 16 is reset. After this state of the flag is stored in the backup RAM within the ECU 1 (S103), the flow proceeds to S104. By contrast, in the case where it is judged that the condition for updating the learned value is not established ("No" at S102), the flow directly proceeds to S104.

At S104, it is judged whether a precondition for starting the defect detection of the evaporative purge system such as the air temperature or atmospheric pressure at the time of starting of the internal combustion engine is established or not. In the case where this precondition is not established ("No" at S104), there is a possibility that defect diagnosis may not be effected correctly, whereby this routine is terminated without effecting the diagnosis.

In the case where it is judged that the precondition for starting the defect detection is established ("Yes" at S104), it is judged whether the valve opening pressure learning end flag for the tank internal pressure regulating valve 16 is set or not (S105). In the case where this flag is reset at the previous S103 ("No" at S105), the flow proceeds to a processing for learning the valve opening pressure of the tank internal pressure regulating valve indicated as S200.

Figure 3:
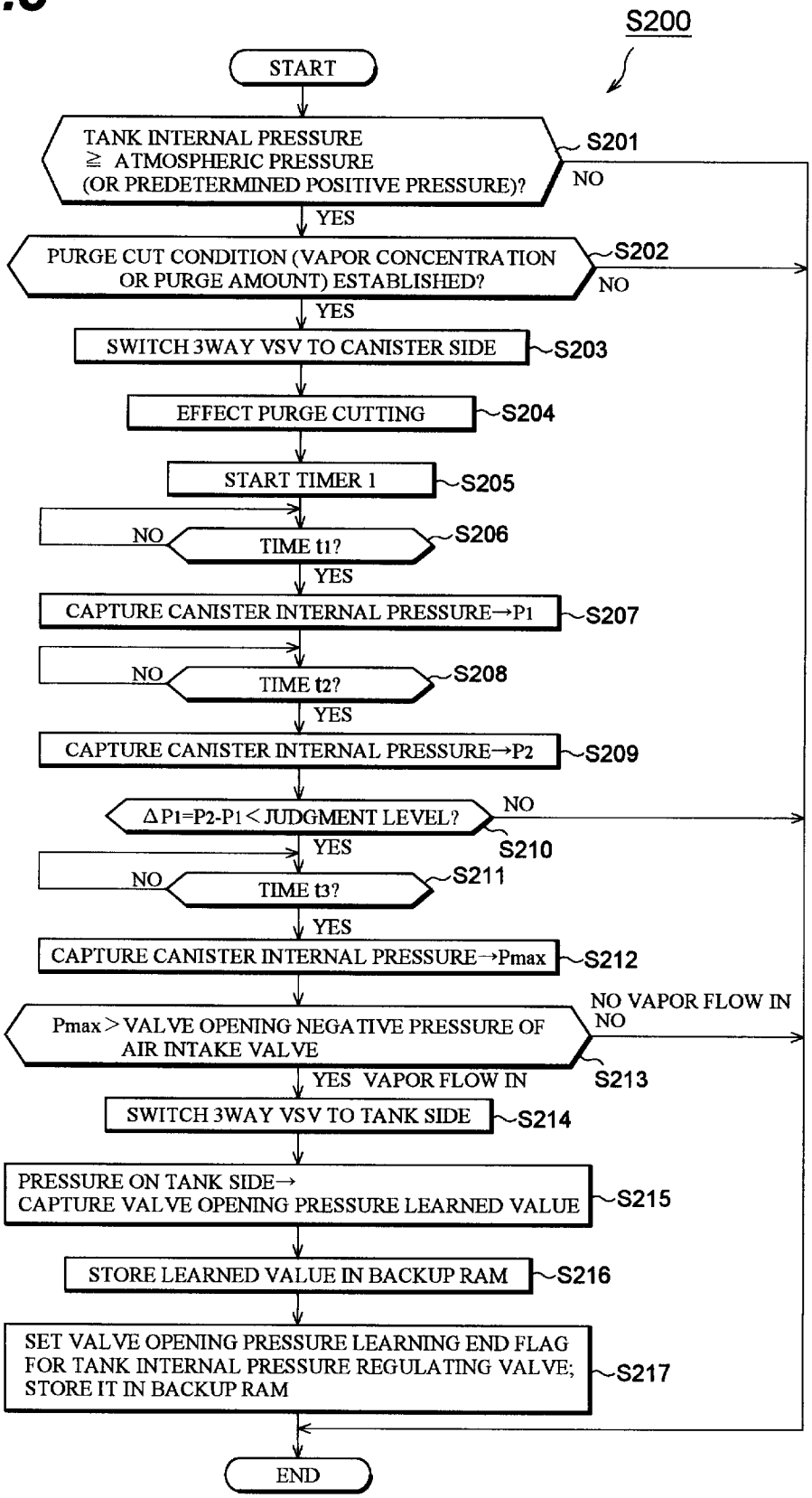
FIG. 3 a flow chart for learning the valve opening pressure of the tank internal pressure regulating valve indicated by S200 in FIG. 2.
Figure 4:
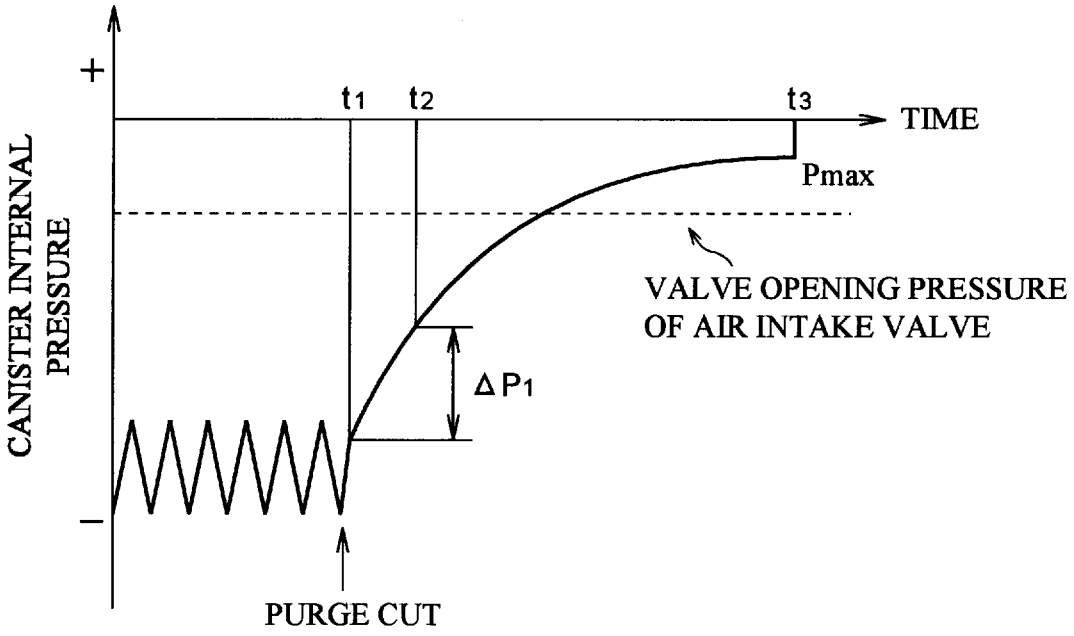
FIG. 4 is a chart showing a pressure behavior on the canister side at the time when the valve opening pressure of the tank internal pressure regulating valve is learned.

Here, the processing for learning the valve opening pressure of the tank internal pressure regulating valve 16 performed at S200 will be explained with reference to FIGS. 3 and 4.

First, after the pressure sensor 120 is connected to the fuel tank 10 side at the previous S101, it is judged, from the pressure signal detected by the pressure sensor 120, whether or not the pressure on the fuel tank 10 side is at least as high as the atmospheric pressure or a predetermined positive pressure (S201). In the case where the pressure on the fuel tank 10 side is lower than the atmospheric pressure or predetermined positive pressure ("No" at S201), it is judged that the tank internal pressure regulating valve 16 is not in condition to open, whereby this routine is terminated.

In the case where it is judged that the pressure on the fuel tank 10 side is not lower than the atmospheric pressure or predetermined positive pressure ("Yes" at S201), it is judged whether or not a purge cut condition, which is judged, for example, on the basis of the vapor concentration or the purge amount, is established or not (S202). In the case where the purge cut condition is not established ("No" at S202), this routine is terminated. By contrast, in the case where the purge cut condition is established ("Yes" at S202), the three-way VSV 121 is switched to the canister 11 side, thereby connecting the pressure sensor 120 to a system path on the canister 11 side (S203).

Subsequently, the purge duty VSV 15 is closed so as to effect purge cutting (S204), and a timer 1 is caused to start counting (S205). This timer 1 is a timer for clocking the timing for feeding the value detected by the pressure sensor 120 into the ECU 1.

Then, the state of change in the in-system pressure on the canister 11 side is investigated. At S206, it is judged whether the counted value (time) of the timer 1 is $t_1$ or not. At the point of time where the counted value becomes $t_1$ ("Yes" at S206), the pressure signal detected by the pressure sensor 120 is captured, and thus captured value is stored as $P_1$ in the RAM within the ECU 1 (S207). Thereafter, at S208, it is judged whether the counted value (time) of the timer 1 is $t_2$ or not. At the point of time where the counted value becomes $t_2$ ("Yes" at S208), the pressure signal detected by the pressure sensor 120 is captured, and thus captured value is stored as $P_2$ in the RAM within the ECU 1 (S209).

At the subsequent S210, $P_1$ and $P_2$ are read out from the RAM, and a pressure difference between $P_1$ and $P_2$, $\Delta P_1 = P_2 - P_1$, is computed. In the case where the resulting value of $\Delta P_1$ is not lower than a predetermined judgment level ("No" at S210), i.e., where the in-system pressure on the canister 11 side is remarkably increased, it can be judged that the amount of vapor generated in the fuel tank 10 is so large that a plenty of vapor is flowing into the system on the canister 11 side. Since the valve opening pressure of the tank internal pressure regulating valve 16 cannot be learned correctly under such circumstances, this routine is terminated.

By contrast, in the case where the value of $\Delta P_1$ is lower than the judgment level ("Yes" at S210), the flow proceeds to S211, where it is judged whether the counted value (time) of the timer 1 is $t_3$ or not. At the point of time where the counted value becomes $t_3$ ("Yes" at S211), the pressure signal detected by the pressure sensor 120 is captured, and thus captured value is stored as $P_{max}$ in the RAM within the ECU 1 (S212). This $t_3$ is a count value defined beforehand as a time necessary for sufficiently ascertaining the pressure behavior in the system on the canister 11 side.

Subsequently, at S213, $P_{max}$ and the valve opening pressure (negative pressure) of the air intake valve 19 stored beforehand are read out from the backup RAM, and their pressure levels are compared with each other. As already explained, in the case where there is no vapor flowing from the fuel tank 10 side, the negative pressure on the canister 11 side after purge cutting is supposed to be stabilized at the valve opening pressure of the air intake valve 19. Accordingly, in the case where the pressure on the canister 11 side during purge cutting is not higher than the valve opening pressure of the air intake valve 19 ("No" at S213), it can be judged that no vapor flowing into the canister 11 side (the tank internal pressure regulating valve 16 is not open), whereby this flow is directly terminated. By contrast, in the case where the value of $P_{max}$ is greater than the valve opening pressure of the air intake valve 19 ("Yes" at S213), it can be judged that the tank internal pressure regulating valve 16 is opened such that the vapor in the fuel tank 10 is flowing into the canister 11 side. Consequently, the three-way VSV 121 is switched to the fuel tank 10 side (S214), and the pressure level on the fuel tank 10 side detected by the pressure sensor 120 at this time is captured as a learned value of valve opening pressure (new valve opening pressure) of the tank internal pressure regulating valve 16 (S215). Then, as this learned value of valve opening pressure is stored in the backup RAM, the valve opening pressure level is updated (S216). Finally, the valve opening pressure learning end flag for the tank internal pressure regulating valve 16 is set, and this state of the flag is stored in the backup RAM (S217), whereby a series of processing flows for learning the valve opening pressure of the tank internal pressure regulating valve 16 are terminated.

Figure 2:
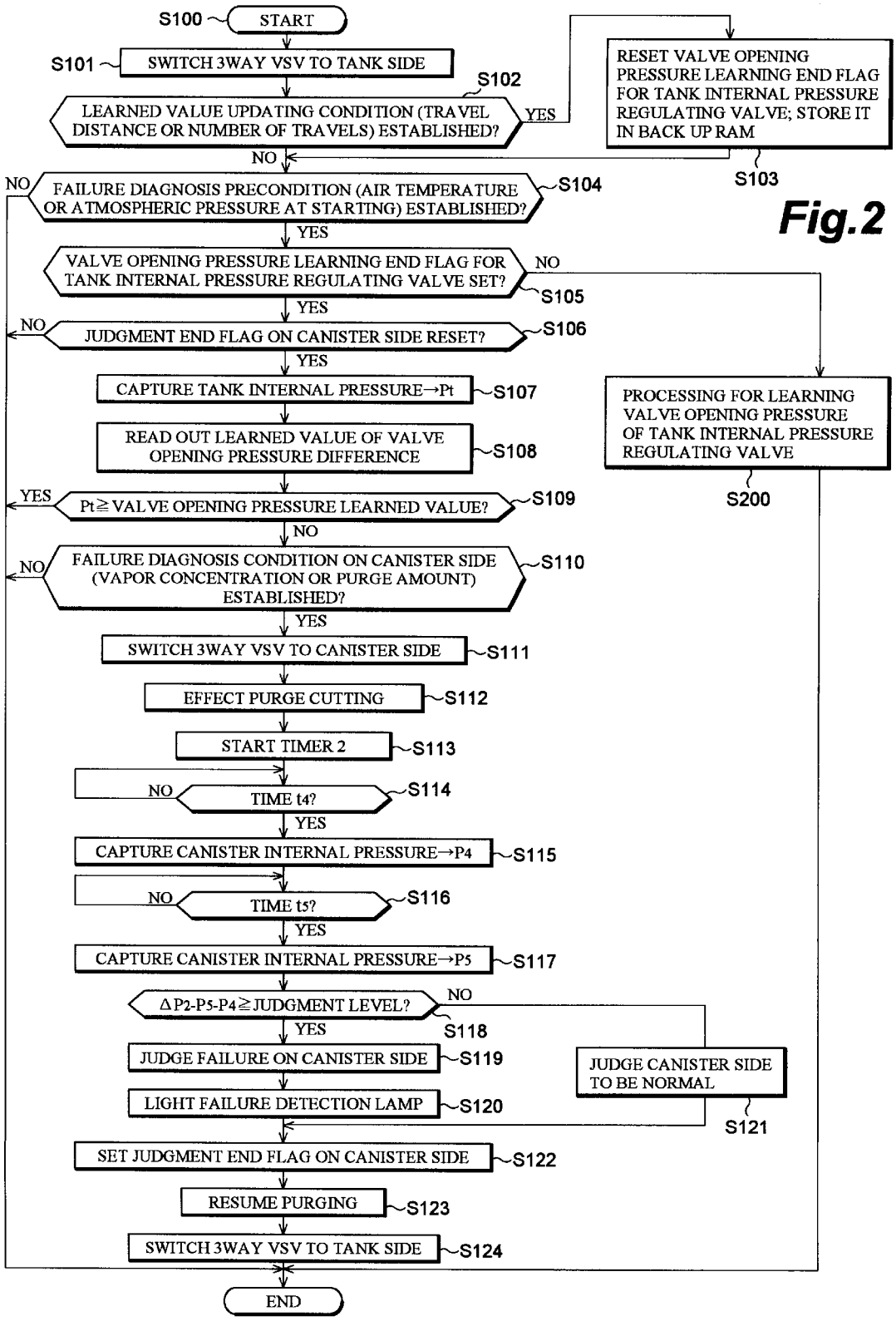
FIG. 2 is a flow chart showing, in the defect diagnosis apparatus in FIG. 1, a diagnosis processing in which the valve opening pressure of the tank internal pressure regulating valve is taken into consideration.

Now, returning to the flow chart of FIG. 2, after the valve opening pressure of the tank internal pressure regulating valve 16 is learned at S200, this routine is terminated. Though S100 to S104 are executed in the next routine, it is judged "No" at S102 in the middle thereof since the valve opening pressure has already been learned.

At S105, since the learning end flag is set at the previous S217 ("Yes" at S105), the flow proceeds to the subsequent S106. At S106, it is judged whether or not a flag indicating that the defect judgment on the canister 11 side has ended is reset. Since the defect judgment has not been effected yet by this point of time, the flag is still in a reset state ("Yes" at S106), whereby the flow proceeds to the subsequent S107.

At S107, prior to the defect judgment processing on the canister 11 side, the in-system pressure on the fuel tank 10 side is detected. Namely, as the pressure sensor 120 is connected to the system path on the fuel tank 10 side at this point of time, the pressure signal detected by the pressure sensor 120 at this time is captured, and thus captured value is defined as $P_t$ (S107). Subsequently, the learned value of valve opening pressure stored at the previous S216 is read out from the backup RAM (S108) and is compared with the value of $P_t$ (S109). In the case where the in-system pressure $P_t$ on the fuel tank 10 side is consequently at least as high as the learned valve opening pressure of the tank internal pressure regulating valve 16, it can be judged that the tank internal pressure regulating valve 16 is open. In such a case, there is a possibility that the defect diagnosis on the canister 11 side may not correctly be effected under the influence of the vapor flowing therein. Accordingly, the defect diagnosis processing in the system on the canister 11 side is inhibited from being effected at S111 and thereafter, whereby this routine is immediately terminated ("Yes" at S109).

By contrast, in the case where the in-system pressure $P_t$ on the fuel tank 10 side is lower than the learned valve opening pressure of the tank internal pressure regulating valve 16 ("No" at S109), it can be judged that the tank internal pressure regulating valve 16 is closed. Therefore, subsequently, it is judged whether or not a condition for detecting a defect on the canister side, which is judged, for example, on the basis of the vapor concentration or the purge amount, is established or not (S110). In the case where this condition is not established ("No" at S110), this routine is terminated. By contrast, in the case where it is judged that the defect diagnosis condition on the canister 11 side is established ("Yes" at S110), after the three-way VSV 121 is switched to the canister 11 side (S111), the purge duty VSV 15 is closed to effect purge cutting (S112), and a timer 2 is caused to start counting (S113). This timer 2 is a timer for clocking the timing for feeding the value detected by the pressure sensor 120 into the ECU 1.

At the subsequent S114, it is judged whether the counted value (time) of the timer 2 is $t_4$ or not. At the point of time where the counted value becomes $t_4$ ("Yes" at S114), the pressure signal detected by the pressure sensor 120 is captured, and thus captured value is stored as $P_4$ in the RAM within the ECU 1 (S115). At the subsequent S116, it is judged whether the counted value (time) of the timer 2 is $t_5$ or not. At the point of time where the counted value becomes $t_5$ ("Yes" at S116), the pressure signal detected by the pressure sensor 120 is captured, and thus captured value is stored as $P_5$ in the RAM within the ECU 1 (S117).

At the subsequent S118, $P_4$ and $P_5$ are read out from the RAM, and a pressure difference between $P_4$ and $P_5$, $\Delta P_2 = P_5 - P_4$, is computed. In the case where the resulting value of $\Delta P_2$ is at least as high as a predetermined judgment level ("Yes" at S118), it is judged that a defect such as perforation is generated in the system on the canister 11 side (S119), and such a processing as lighting of a defect detection lamp (S120) is effected so as to inform the driver that the defect has occurred. By contrast, in the case where the value of $\Delta P_2$ is lower than the judgment level ("No" at S118), it is judged that no defect such as perforation is generated in the system on the canister 11 side (S121).

Upon completion of such a judgment processing, a judgment end flag on the canister side is set (S122). When this flag is set, under the control of the ECU 1, the purge duty VSV 15 is opened, whereby purge control is resumed (S123). Further, the three-way VSV 121 is switched to the fuel tank 10 side, so that the pressure sensor 120 is set so as to be able to detect the pressure on the fuel tank 10 side (S124), whereby this flow is terminated.

When the defect diagnosis apparatus for evaporative purge system is thus configured, the actual valve opening pressure of the tank internal pressure regulating valve 16 can always be grasped, whereby the defect diagnosis on the canister 11 side can be effected under the circumstances where the tank internal pressure regulating valve 16 is securely closed.

In the following, the defect diagnosis processing in the case where the valve opening pressure of the back-purge valve 17 is taken into consideration will be explained with reference to the flow chart of FIG. 5. This processing operation is a routine processing which is performed, for example, at every predetermined time in the ECU 1 in the state where purging is effected.

When this processing, which is started at step 300, is actuated, the three-way VSV 121 is switched to the fuel tank 10 side so as to connect the pressure sensor 120 to the system path on the fuel tank 10 side, thereby detecting the pressure in this system (S301).

Then, it is judged whether a condition for updating a learned value of the valve opening pressure of the back-purge valve 17 is established or not (S302). Examples of this condition include the distance traveled and number of travels from the point of time where the last learning is effected. The learning of the valve opening pressure is effected for every predetermined travel distance or number of travels. In the case where it is judged that the condition for updating the learned value is established ("Yes" at S302), the valve opening pressure learning end flag for the back-purge valve 17 is reset. After this state of the flag is stored in the backup RAM within the ECU 1, the flow proceeds to S304. By contrast, in the case where it is judged that the condition for updating the learned value is not established ("No" at S302), the flow directly proceeds to S304.

At S304, it is judged whether a precondition for starting the defect detection of the evaporative purge system such as the air temperature or atmospheric pressure at the time of starting of the internal combustion engine is established or not. In the case where this precondition is not established ("No" at S304), there is a possibility that defect diagnosis may not be effected correctly, whereby this routine is terminated without effecting the diagnosis.

In the case where it is judged that the precondition for starting the defect detection is established ("Yes" at S304), it is judged whether the valve opening pressure learning end flag for the back-purge valve 17 is set or not (S305). In the case where this flag is reset at the previous S303 ("No" at S305), the flow proceeds to a processing for learning the valve opening pressure of the back-purge valve 17 indicated as S400.

Figure 6:
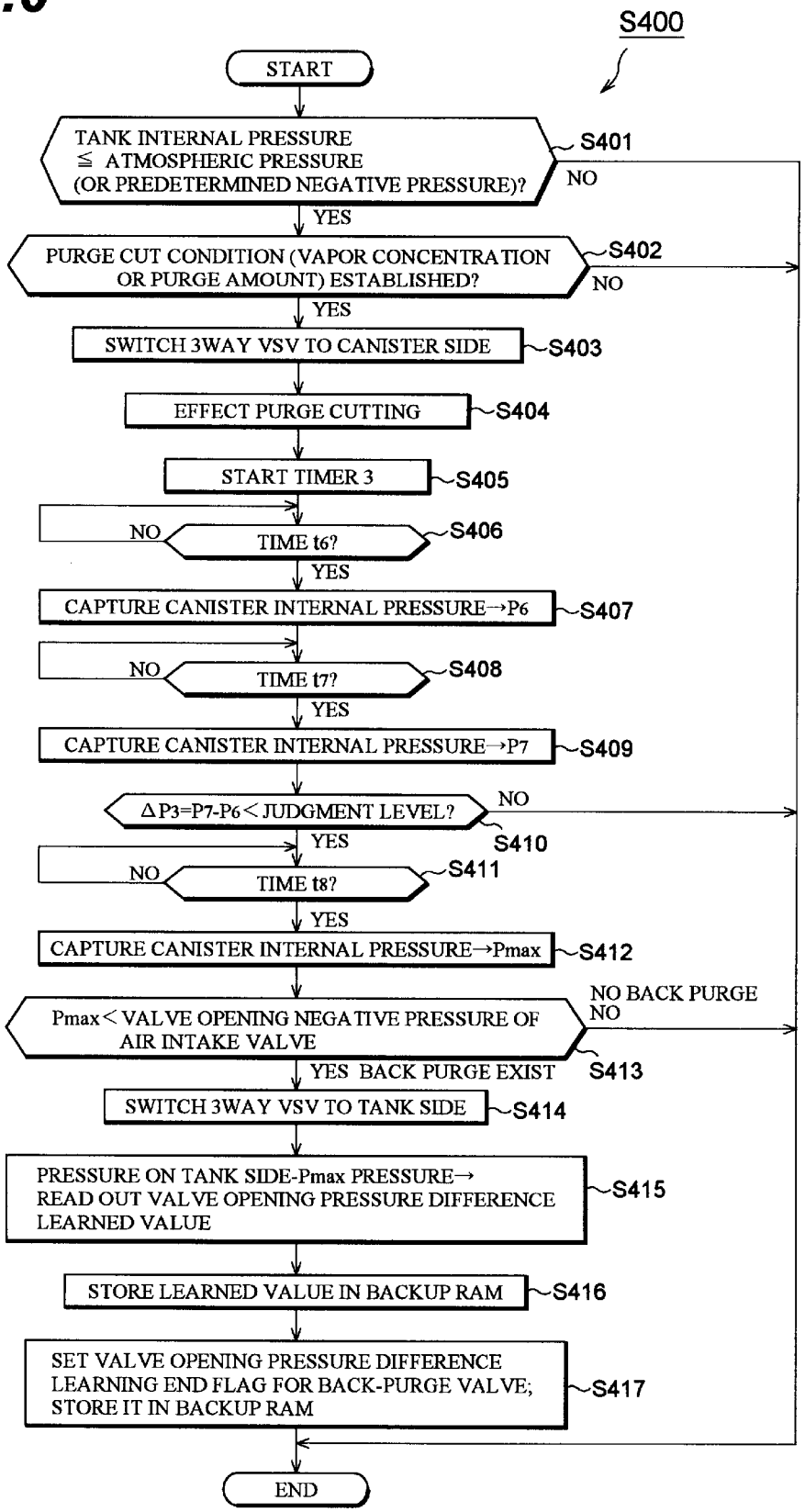
FIG. 6 is a flow chart for learning the valve opening pressure of the back-purge valve indicated by S400 in FIG. 5.
Figure 7:
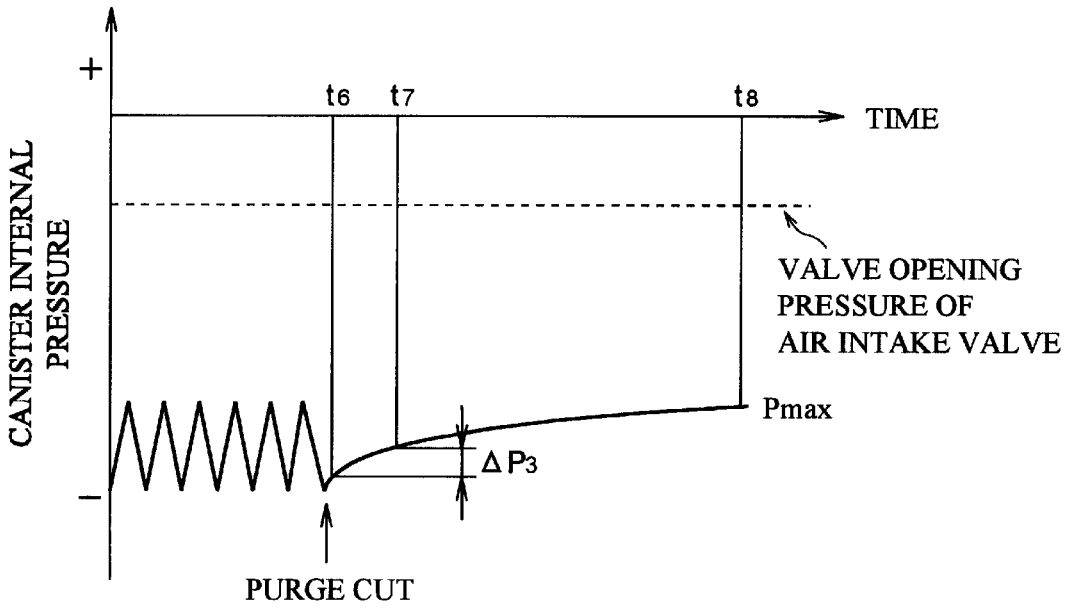
FIG. 7 is a chart showing a pressure behavior on the canister side at the time when the valve opening pressure of the back-purge valve is learned.
Figure 8:
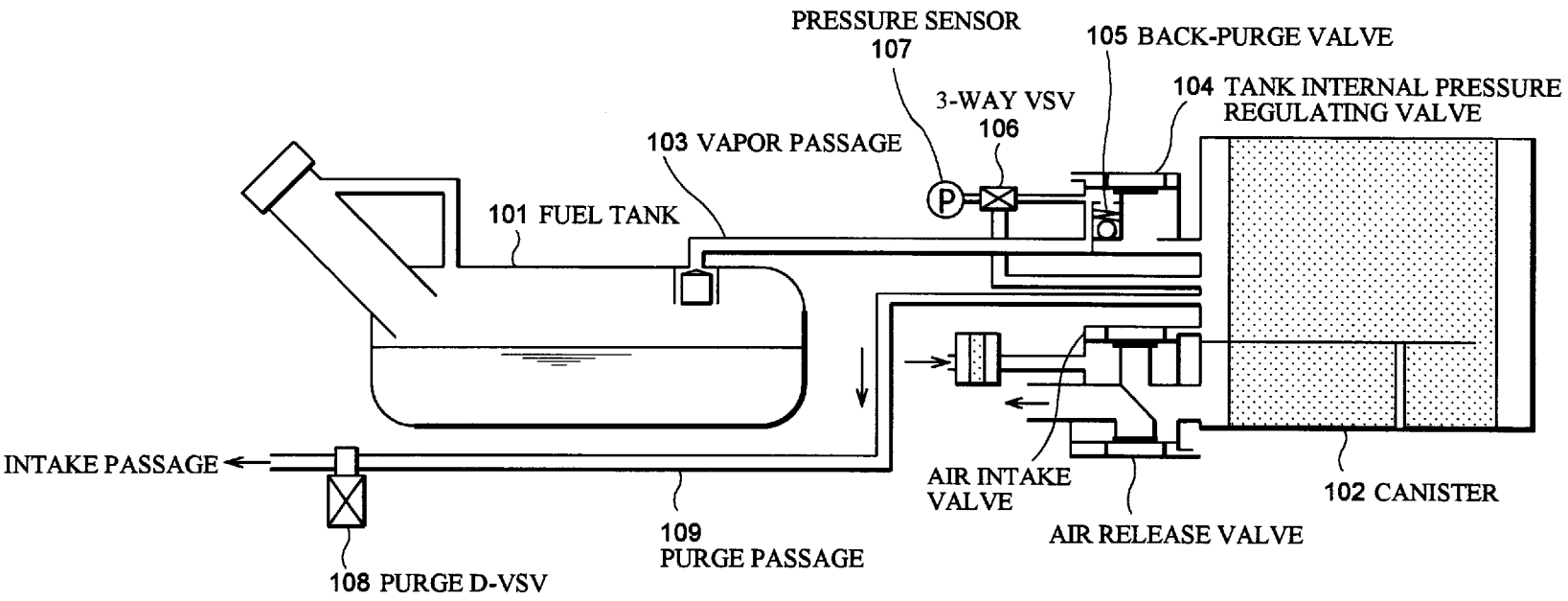
FIG. 8 is a configurational view showing a defect diagnosis apparatus for evaporative purge system.
Figure 9:
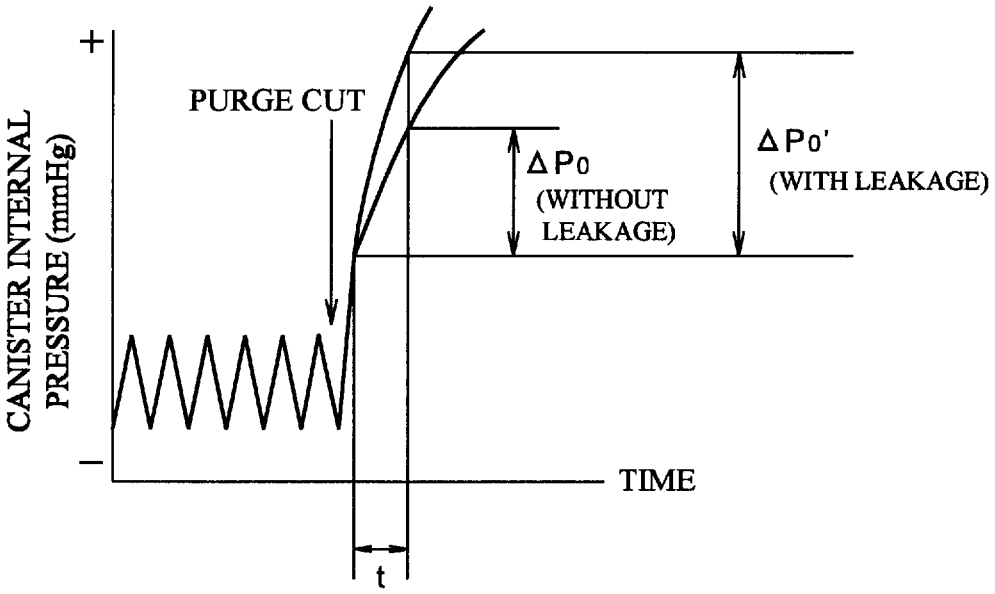
FIG. 9 is a graph explaining that the canister internal pressure shifts differently in a negative pressure region depending on whether leakage occurs or not.

Here, the processing for learning the valve opening pressure of the back-purge valve 17 performed at S400 will be explained with reference to FIGS. 6 and 7.

First, after the pressure sensor 120 is connected to the fuel tank 10 side at the previous S301, it is judged, from the pressure signal detected by the pressure sensor 120, whether or not the pressure on the fuel tank 10 side is at least as low as the atmospheric pressure or a predetermined negative pressure (S401). In the case where the pressure on the fuel tank 10 side is higher than the atmospheric pressure or predetermined negative pressure ("No" at S401), it is judged that the back-purge valve 17 is not in condition to open, whereby this routine is terminated.

In the case where it is judged that the pressure on the fuel tank 10 side is not higher than the atmospheric pressure or predetermined negative pressure ("Yes" at S401), it is judged whether or not a purge cut condition, which is judged, for example, on the basis of the vapor concentration or the purge amount, is established or not (S402). In the case where the purge cut condition is not established ("No" at S402), this routine is terminated. By contrast, in the case where the purge cut condition is established ("Yes" at S402), the three-way VSV 121 is switched to the canister 11 side, thereby connecting the pressure sensor 120 to the system path on the canister 11 side (S403).

Subsequently, the purge duty VSV 15 is closed so as to effect purge cutting (S404), and a timer 3 is caused to start counting (S405). This timer 3 is a timer for clocking the timing for feeding the value detected by the pressure sensor 120 into the ECU 1.

Then, the state of change in the in-system pressure on the canister 11 side is investigated. At S406, it is judged whether the counted value (time) of the timer 3 is $t_6$ or not. At the point of time where the counted value becomes $t_6$ ("Yes" at S406), the pressure signal detected by the pressure sensor 120 is captured, and thus captured value is stored as $P_6$ in the RAM within the ECU 1 (S407). Thereafter, at S408, it is judged whether the counted value (time) of the timer 3 is $t_7$ or not. At the point of time where the counted value becomes $t_7$ ("Yes" at S408), the pressure signal detected by the pressure sensor 120 is captured, and thus captured value is stored as $P_7$ in the RAM within the ECU 1 (S409).

At the subsequent S410, $P_6$ and $P_7$ are read out from the RAM, and a pressure difference between $P_6$ and $P_7$, $\Delta P_3 = P_7 - P_6$, is computed. In the case where the resulting value of $\Delta P$, is not lower than a predetermined judgment level ("No" at S410), i.e., where the in-system pressure on the canister 11 side is remarkably increased, it can be judged that the amount of vapor generated in the fuel tank 10 is so large that a plenty of vapor is flowing into the system on the canister 11 side. Since the valve opening pressure of the tank internal pressure regulating valve 16 cannot be learned correctly under such circumstances, this routine is terminated.

By contrast, in the case where the value of $\Delta P_3$ is lower than the judgment level ("Yes" at S410), the flow proceeds to S411, where it is judged whether the counted value (time) of the timer 3 is $t_8$ or not. At the point of time where the counted value becomes $t_8$ ("Yes" at S411), the pressure signal detected by the pressure sensor 120 is captured, and thus captured value is stored as $P_{max}$ in the RAM within the ECU 1 (S412). This $t_8$ is a count value defined beforehand as a time necessary for sufficiently ascertaining the pressure behavior in the system on the canister 11 side.

Subsequently, at S413, $P_{max}$ and the valve opening pressure (negative pressure) of the air intake valve 19 stored beforehand are read out from the RAM, and their pressure levels are compared with each other. As already explained, in the case where there is no vapor flowing from the fuel tank 10 side, the negative pressure on the canister 11 side after purge cutting is supposed to be stabilized at the valve opening pressure of the air intake valve 19. Accordingly, in the case where the pressure on the canister 11 side during purge cutting is at least as high as the valve opening pressure of the air intake valve 19 ("No" at S413), it can be judged that no back purge is generated (the back-purge valve 17 is not open), whereby this flow is directly terminated. By contrast, in the case where the value of $P_{max}$ is lower than the valve opening pressure of the air intake valve 19 ("Yes" at S413), it can be judged that the back purge valve 17 is opened such that the vapor in the fuel tank 10 is attracted to the fuel tank 10 side. Consequently, the three-way VSV 121 is switched to the fuel tank 10 side (S414), and the pressure difference (becoming a negative value in this case) between the pressure on the fuel tank 10 side and $P_{max}$ detected by the pressure sensor 120 at this time is captured as a learned value of valve opening pressure (new valve opening pressure) of the back-purge valve 17 (S415). Then, as this learned value of valve opening pressure is stored in the backup RAM, the valve opening pressure level is updated (S416). Finally, the valve opening pressure learning end flag for the tank internal pressure regulating valve 16 is set, and this state of the flag is stored in the backup RAM (S417), whereby a series of processing flows for learning the valve opening pressure of the back-purge valve 17 are terminated.

Figure 5:
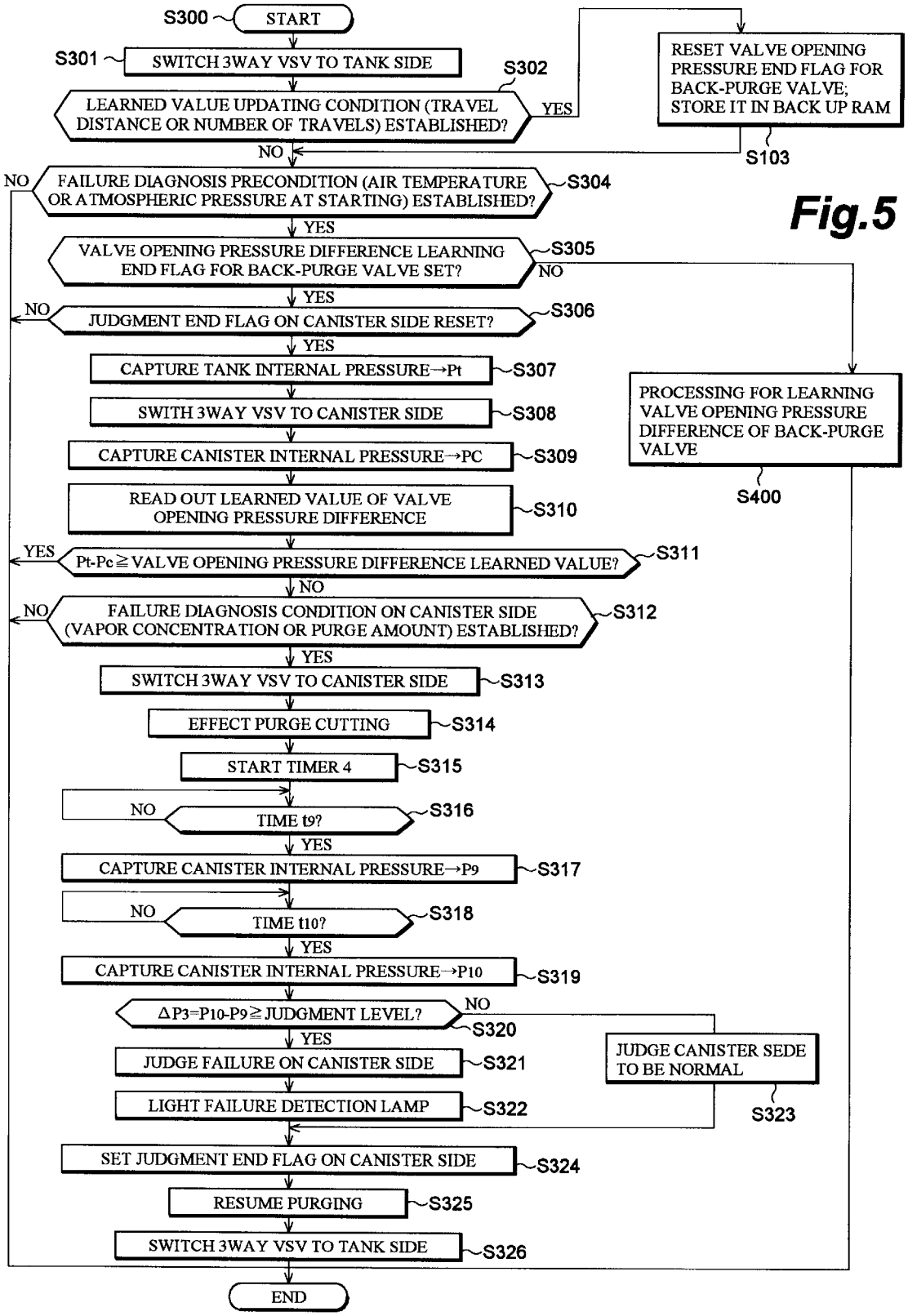
FIG. 5 is a flow chart showing, in the defect diagnosis apparatus in FIG. 1, a diagnosis processing in which the valve opening pressure of the back-purge valve is taken into consideration.

Now, returning to the flow chart of FIG. 5, after the valve opening pressure of the back-purge valve 17 is learned at S400, this routine is terminated. Though S300 to S304 are executed in the next routine, it is judged "No" at S302 in the middle thereof since the valve opening pressure has already been learned.

At S305, since the learning end flag is set at the previous S417 ("Yes" at S305), the flow proceeds to the subsequent S306. At S306, it is judged whether or not a flag indicating that the defect judgment on the canister 11 side has ended is reset. Since the defect judgment has not been effected yet by this point of time, the flag is still in a reset state ("Yes" at S306), whereby the flow proceeds to the subsequent S307.

At S307, prior to the defect judgment processing on the canister 11 side, a pressure difference between the in-system pressures on the fuel tank 10 side and canister 11 side is detected. First, as the pressure sensor 120 is connected to the system path on the fuel tank 10 side at this point of time, the pressure signal detected by the pressure sensor 120 at this time is captured, and thus captured value is defined as $P_t$ (S307). Subsequently, after the three-way VSV 121 is switched to the canister 11 side (S308), the pressure signal detected by the sensor 120 is captured and defined as $P_c$ (S309). Further, the learned value of valve opening pressure stored at the previous S416 is read out from the backup RAM (S310). Then, the pressure difference between the in-system pressures on the fuel tank 10 side and canister 11 side, $P_t - P_c$ (negative value), is compared with the learned value (negative value) that has been read out (S311). In the case where the resulting pressure difference $P_t - P_c$ is at least as low as the learned valve opening pressure that has been read out ("Yes" at S311), it can be judged that the back-purge valve 17 is open. In such a case, there is a possibility that the defect diagnosis on the canister 11 side may not correctly be effected under the influence of back purge. Accordingly, the defect diagnosis processing in the system on the canister 11 side is inhibited from being effected at S313 and thereafter, whereby this routine is immediately terminated.

By contrast, in the case where the pressure difference $P_t-P_c$ is greater than the learned valve opening pressure that has been read out ("No" at S311), it can be judged that the back-purge valve 17 is closed. Therefore, it is judged whether or not a condition for detecting a defect on the canister side, which is judged, for example, on the basis of the vapor concentration or the purge amount, is established or not (S312). In the case where this condition is not established ("No" at S312), this routine is terminated. By contrast, in the case where it is judged that the defect diagnosis condition on the canister 11 side is established ("Yes" at S312), after the three-way VSV 121 is switched to the canister 11 side (S313), the purge duty VSV 15 is closed to effect purge cutting (S314), and a timer 4 is caused to start counting (S315). This timer 4 is a timer for clocking the timing for feeding the value detected by the pressure sensor 120 into the ECU 1.

At S316, it is judged whether the counted value (time) of the timer 4 is $t_9$ or not. At the point of time where the counted value becomes $t_9$ ("Yes" at S316), the pressure signal detected by the pressure sensor 120 is captured, and thus captured value is stored as $P_9$ in the RAM within the ECU 1 (S317). At the subsequent S318, it is judged whether the counted value (time) of the timer 4 is $t_{10}$ or not. At the point of time where the counted value becomes $t_{10}$ ("Yes" at S318), the pressure signal detected by the pressure sensor 120 is captured, and thus captured value is stored as $P_{10}$ in the RAM (S319).

At the subsequent S320, $P_9$ and $P_{10}$ are read out from the RAM, and a pressure difference between $P_9$ and $P_{10}$, $\Delta P_3=P_{10}-P_9$, is computed. In the case where the resulting value of $\Delta P_3$ is at least as high as a predetermined judgment level ("Yes" at S320), it is judged that a defect such as perforation is generated in the system on the canister 11 side (S321), and such a processing as lighting of a defect detection lamp (S322) is effected so as to inform the driver that the defect has occurred. By contrast, in the case where the value of $\Delta P_3$ is lower than the judgment level ("No" at S320), it is judged that no defect such as perforation is generated in the system on the canister 11 side (S323).

Upon completion of such a judgment processing, a judgment end flag on the canister side is set (S324). When this flag is set, under the control of the ECU 1, the purge duty VSV 15 is opened, whereby purge control is resumed (S325). Further, the three-way VSV 121 is switched to the fuel tank 10 side, so that the pressure sensor 120 is set so as to be able to detect the pressure on the fuel tank 10 side (S326), whereby this flow is terminated.

When the defect diagnosis apparatus for evaporative purge system is thus configured, the actual valve opening pressure of the back-purge valve 17 can always be grasped, whereby the defect diagnosis on the canister 11 side can be effected under the circumstances where the back-purge valve 17 is securely closed.

As explained in the foregoing, in the defect diagnosis apparatus for evaporative purge system in accordance with each invention, since it is provided with learning means for learning the valve opening pressure of a pressure regulating valve which adjusts the pressure in the fuel tank, the actual valve opening pressure of the pressure regulating valve can be grasped, and as the result of this learning is utilized, defect diagnosis can correctly be effected under the circumstances where the pressure regulating valve is securely closed. Also, as the actual valve opening pressure can be grasped, it becomes unnecessary for a diagnosable pressure range to be set beforehand as conventionally necessitated, whereby defect diagnosis can be effected as frequently as possible.

As stated above, the defect diagnosing apparatus for diagnosing a defect of the evaporation purge system, the evaporation purge system having: the fuel tank 10; the canister 11; the vapor passage 13 connecting the fuel tank 10 and the canister 11; and the purge passage 14 connecting to the canister 11 to the suction passage 12 connected to a combustion chamber CH of an engine EG, said apparatus comprises: the air intake valve 19 provided between the canister 11 and the external atmosphere, the air intake valve 19 opening to cause the canister 11 be connected to the external atmosphere via the air intake valve 19 when the pressure in the canister 11 is lower than a predetermined pressure; a pressure regulating valve 16 or 17 provided between the fuel tank 10 and the canister 11; a vapor control valve 15 provided on the purge passage 15; a pressure sensor 120 connected to at least one of the canister 11, the vapor passage 13, the fuel tank 10 and the purge passage 14; and a control unit 1 that finds a valve opening pressure of the pressure regulating valve 16 or 17 by evaluating the output of the pressure sensor 120 when the vapor control valve 15 is closed and a valve opening pressure of said air intake valve 19, and that make a diagnosis of the defect of the evaporation purge system based on the output from the pressure sensor 120 when the found valve opening pressure satisfies a predetermined condition.

The pressure sensor 120 is selectively connected to the canister 11 or the fuel tank 10.

The predetermined condition may be when the found valve opening pressure is greater than a pressure in the fuel tank 10. The control unit 1 prohibits the diagnosis when the found valve opening pressure is not more than the pressure in the fuel tank 10. The pressure in the fuel tank 10 is detected by the pressure sensor 120.

The predetermined condition may be when the found valve opening pressure is greater than the difference between pressures in the fuel tank 10 and the canister 11. The control unit 1 prohibits the diagnosis when the found valve opening pressure is not more than the difference between pressures in the fuel tank 10 and the canister 11. The pressure in the fuel tank 10 is detected by the pressure sensor 120.

Further, the control unit 1 finds the valve opening pressure of the pressure regulating valve 16 by storing the value of the pressure in the fuel tank 10 when the output of the pressure sensor 120 indicates that the pressure in the canister 11 when the vapor control valve 15 is closed is not less than the valve opening pressure of the air intake valve 19.

Further, the control unit 1 finds the valve opening pressure of the pressure regulating valve 17 by storing the value of the difference between the pressures in the canister 11 and the fuel tank 10 when the output of the pressure sensor 120 indicates that the pressure in the canister 11 when the vapor control valve is closed is stable and less than the valve opening pressure of the air intake valve 19.

The pressure regulating valve may be a tank internal pressure regulating valve 16 that opens to communicate the fuel tank 10 and the canister 11 when the pressure of the fuel tank 10 is greater than a first predetermined pressure.

The pressure regulating valve may be a back-purge valve 17 that opens to communicate the fuel tank 10 and the canister 11 when the pressure of the fuel tank 10 is smaller than a second predetermined pressure. Note that the first predetermined pressure is greater than the external atmosphere, and the external atmosphere is greater than the second predetermined pressure which is positive pressure.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 212611/1996 filed on Aug. 12, 1996 is hereby incorporated by reference.

What is claimed is:

1. A defect diagnosing apparatus for diagnosing a defect of an evaporation purge system, said evaporation purge system having: a fuel tank; a canister; a vapor passage connecting said fuel tank and said canister; and a purge passage connecting said canister to a suction passage connected to a combustion chamber of an engine, said apparatus comprising;

an air intake valve provided between said canister and the external atmosphere, said air intake valve opening to cause said canister to be connected to the external atmosphere via said air intake valve when the pressure in said canister is lower than a predetermined pressure;

a pressure regulating valve provided between said fuel tank and said canister;

a vapor control valve provided on said purge passage;

a pressure sensor connected to at least one of said canister, said vapor passage, said fuel tank, and said purge passage; and a control unit that determines a valve opening pressure of said pressure regulating valve by evaluating the output of said pressure sensor when said vapor control valve is closed, determines a valve opening pressure of said air intake valve, and makes a diagnosis of the defect of said evaporation purge system based on the output from said pressure sensor when said determined valve opening pressure of said pressure regulating valve satisfies a predetermined condition.

2. A defect diagnosing apparatus according to claim 1, wherein said pressure sensor is selectively connected to said canister or said fuel tank.

3. A defect diagnosing apparatus according to claim 1, wherein said predetermined condition is when said determined valve opening pressure of said pressure regulating valve is greater than a pressure in said fuel tank.

4. A defect diagnosing apparatus according to claim 3, wherein said control unit prohibits said diagnosis when said determined valve opening pressure of said pressure regulating valve is not more than the pressure in said fuel tank.

5. A defect diagnosing apparatus according to claim 3, the pressure in said fuel tank is detected by said pressure sensor.

6. A defect diagnosing apparatus according to claim 1, wherein said predetermined condition is when said determined valve opening pressure is greater than the difference between pressures in said fuel tank and said canister.

7. A defect diagnosing apparatus according to claim 6, wherein said control unit prohibits said diagnosis when said found valve opening pressure of said pressure regulating valve is not more than the difference between pressures in said fuel tank and said canister.

8. A defect diagnosing apparatus according to claim 6, wherein the pressure in said fuel tank is detected by said pressure sensor.

9. A defect diagnosing apparatus according claim 1, wherein said control unit determines the valve opening pressure of said pressure regulating valve by storing the value of the pressure in said fuel tank when the output of said pressure sensor indicates that the pressure in said canister when said vapor control valve is closed is not less than the valve opening pressure of said air intake valve.

10. A defect diagnosing apparatus according to claim 1, wherein said control unit determines the valve opening pressure of said pressure regulating valve by storing the value of the difference between the pressures in said canister and said fuel tank when the output of said pressure sensor indicates that the pressure in said canister when said vapor control valve is closed is stable and less than the valve opening pressure of said air intake valve.

11. A defect diagnosing apparatus according to claim 1, said pressure regulating valve being a tank internal pressure regulating valve that opens to communicate said fuel tank and said canister when the pressure of said fuel tank is greater than a first predetermined pressure.

12. A defect diagnosing apparatus according to claim 1, said pressure regulating valve being a back-purge valve that opens to communicate said fuel tank and said canister when the pressure of said fuel tank is smaller than a second predetermined pressure.

* * * * *

UNITED STATES PATENT AND TRADEMARK OFFICE

CERTIFICATE OF CORRECTION

PATENT NO. : 5,816,222

DATED : October 6, 1998

INVENTOR(S) : Toru KIDOKORO

It is certified that error appears in the above-indentified patent and that said Letters Patent is hereby corrected as shown below:

| Column | Line | |
|---|---|---|
| 2 | 58 | After "feed" delete "an". |
| 2 | 23 | Change "there is" to --there were--. |
| 8 | 28 | Before "plenty" delete "a". |
| 8 | 54 | After "vapor" insert --is--. |
| 11 | 53 | Change "$\Delta$**P**" to --$\Delta P_3$--. |
| 13 | 63 | Change "each invention" to --each embodiment--. |
| 14 | 12 | After "connecting" delete "to". |
| 14 | 17 | After "canister **11**" insert --to--. |
| 14 | 29 | Change "that make" to --that makes--. |
| 14 | 35 | Change "may be" to --may occur--. |
| 14 | 37 | Change "prohibits" to --prevents--. |

UNITED STATES PATENT AND TRADEMARK OFFICE

CERTIFICATE OF CORRECTION

PATENT NO. : 5,816,222

DATED : October 6, 1998

INVENTOR(S) : Toru KIDOKORO

It is certified that error appears in the above-indentified patent and that said Letters Patent is hereby corrected as shown below:

| Column | Line | |
|---|---|---|
| 14 | 41 | Change "may be" to --may occur--. |
| 14 | 44 | Change "prohibits" to --prevents--. |
| 15 | 22 | After "comprising" change ";" to --:--. |
| 15 | 48 | Change "condition is" to --condition occurs--. |
| 16 | 7 | After "claim **3**," insert --wherein--. |
| 16 | 11 | Change "condition is" to --condition occurs--. |
| 16 | 37 | After "claim **1**," insert --wherein--. |
| 16 | 42 | After "claim **1**," insert --wherein--. |

Signed and Sealed this

Twenty-third Day of November, 1999

*Attest:*

Q. TODD DICKINSON

*Attesting Officer*

*Acting Commissioner of Patents and Trademarks*